US005857442A

United States Patent [19]

Sumi

[11] Patent Number: 5,857,442

[45] Date of Patent: Jan. 12, 1999

[54] INTERNAL COMBUSTION ENGINE LUBRICATING SYSTEM

[75] Inventor: Hiromi Sumi, Saitama, Japan

[73] Assignee: Honda Giken Kogyo Kabushiki Kaisha, Tokyo, Japan

[21] Appl. No.: 971,129

[22] Filed: Nov. 13, 1997

[30] Foreign Application Priority Data

Nov. 13, 1996 [JP] Japan ..... 8-301521

[51] Int. Cl.[6] ..... F01M 1/00

[52] U.S. Cl. ..... 123/196 R; 123/196 CP; 184/6.28

[58] Field of Search ..... 123/196 R, 196 CP; 184/6.28

[56] References Cited

U.S. PATENT DOCUMENTS

| | | | |
|---|---|---|---|
| 3,485,324 | 12/1969 | Novak | 184/6 |
| 4,462,350 | 7/1984 | Kurata . | |
| 4,729,349 | 3/1988 | Sonoda et al. | 123/30.34 |
| 4,898,207 | 2/1990 | Ueki et al. | 137/539 |

FOREIGN PATENT DOCUMENTS 61-35684 10/1986 Japan .

*Primary Examiner*—Henry Yuen
*Assistant Examiner*—Hai Huynh
*Attorney, Agent, or Firm*—Birch, Stewart, Kolasch & Birch, LLP

[57] ABSTRACT

To prevent oil in which air is mixed from being led to an oil pump, preventing the number of parts from being increased in a lubricating system of an internal combustion engine wherein an oil relief valve dipped in oil in an oil pan is connected to a halfway part of a feed oil passage connecting the oil pan and an oil filter. An oil passage extends approximately horizontally and a connecting hole is provided with an axis approximately perpendicular to the oil passage for communicating with the oil passage which is open on the upper surface of a passage forming part formed in the passage forming part integrated with the bottom of an oil pan. An oil relief valve is coaxially connected to the connecting hole with the pressure receiving surface of its plunger directed downwardly. A wall part surrounds the oil relief valve on the side of an oil strainer and is integrated with the bottom of the oil pan.

14 Claims, 5 Drawing Sheets

INTERNAL COMBUSTION ENGINE LUBRICATING SYSTEM

BACKGROUND OF THE INVENTION

1. Field of the Invention

The present invention relates to a lubricating system for an internal combustion engine wherein an oil relief valve dipped in oil in an oil pan is connected to a halfway part of a feed oil passage connecting an oil pump and an oil filter.

2. Description of the Background Art

Such a lubricating system is disclosed in Japanese published examined utility model application No. Sho 60-40804, Japanese published examined utility model application No. Sho 61-35684 for example and others.

In the above conventional type, an oil relief valve is arranged with the pressure receiving surface of its plunger directed upwardly and a relief port provided in the housing of the oil relief valve to be opened or closed by the plunger is located in an upper position near to an oil level in the oil pan. Therefore, air at the oil level is mixed in relief oil discharged from the relief port of the oil relief valve and is readily frothed, and oil in which air is mixed may be led to the oil pump. In the above Japanese published examined utility model application No. Sho 61-35684, an oil relief valve is covered, however, in such a construction, a cover is required and the number of parts is increased.

SUMMARY AND OBJECTS OF THE INVENTION

The present invention is made to solve the above problem and the object is to provide the lubricating system of an internal combustion engine wherein oil including air can be prevented from being led to an oil pump, avoiding an increase in the number of parts.

To achieve the above object, the present invention includes a lubricating system of an internal combustion engine wherein an oil relief valve is provided with a housing provided with a relief port on the peripheral wall. A plunger is provided with a pressure receiving surface at one end for enabling opening or closing of the relief port and is fitted to the housing so that the plunger can be moved. Spring means are provided for pressing the plunger in a direction in which the relief port is closed. The spring means is formed by casting and is dipped in oil in an oil pan coupled to the lower end of a crankcase. The oil relief valve is connected to a halfway part of a feed oil passage connecting an oil pump and an oil filter. The oil filter is attached to the outside surface of the oil pan. An oil passage constituting a part of the feed oil passage extends approximately horizontally and is connected to the oil filter. A connecting hole is provided with an axis approximately perpendicular to the oil passage, communicating with the middle part of the oil passage and an open on the upper surface of a passage forming part are formed in the passage forming part integrated with the bottom of the oil pan. The oil relief valve is supported by at least either of the oil pan or a crankcase and is coaxially connected to the connecting hole with the pressure receiving surface of its plunger directed downwardly. The oil relief valve is covered on the side of an oil strainer arranged in the oil pan and is connected to the oil pump. A wall extends up to an upper position relative to the relief port of the oil relief valve and is integrated with the bottom of the oil pan.

According to the present invention, the oil relief valve is connected to the connecting hole provided in the passage forming part integrated with the bottom of the oil pan with the pressure receiving surface of its plunger directed downwardly. The relief port of the oil relief valve can be arranged in a relatively low position in the oil pan, therefore oil is discharged from the relief port located in a relatively low position distant from an oil level in the oil pan. Air at the oil level and oil from the relief port can be prevented from being mixed to the utmost. As the wall is provided between the oil relief valve and the oil strainer, oil flowing out of the relief port does not flow on the side of the oil strainer directly, as air is removed from oil while the oil flows around the wall even if air is mixed in the oil flowing out of the relief port, air can be prevented from being mixed in oil to be sucked by the oil strainer to the utmost. In addition, as the wall is integrated with the oil pan, the number of parts is not increased.

According to the present invention, as the above oil passage and connecting hole are formed as a cast hole when the oil pan is cast, it is not required to form the oil passage and the connecting hole by punching after the oil pan is cast and the number of processes for producing the oil pan can be reduced.

Further, according to the present invention, a cast hole extending linearly is formed in a crankcase formed by casting, as a bolt for partitioning the east hole into an oil passage communicating with the oil pump and an oil passage one end of which is connected to the oil filter and the other end of which communicates with a main gallery is screwed to the crankcase, the constitution of the feed oil passage can be further simplified and the number of processes of the crankcase after casting can be reduced.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENT

Referring to the attached drawings, an embodiment of the present invention will be described below.

Figure 1:
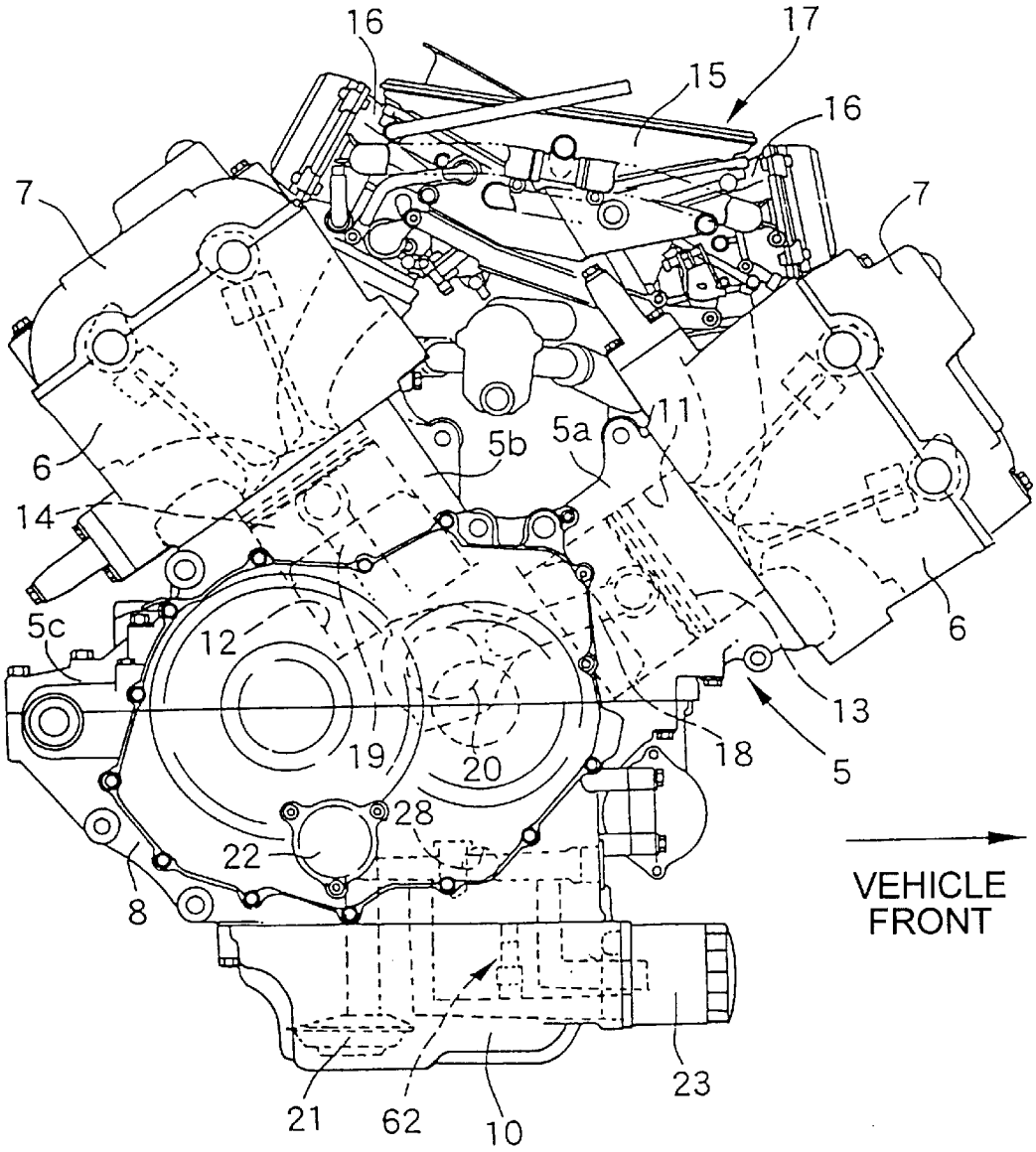
FIG. 1 is a side view showing a V-type two-cylinder internal combustion engine.

First, as shown in FIG. 1, the above V-type two-cylinder internal combustion engine is mounted in a motorcycle for example, a cylinder block 5 consists of a front cylinder part 5*a* arranged on the front side (on the right side in FIG. 1 and on the upper side in FIG. 2) in a vehicular travel direction, a rear cylinder part 5*b* is arranged on the rear side in the vehicular travel direction which forms an approximate V shape together with the front cylinder part 5*a* and an upper crankcase part 5*c* formed by connecting the respective lower parts of the cylinder parts 5*a* and 5*b*, a cylinder head 6 is connected to each upper end of both cylinder parts 5*a* and 5*b* and a head cover 7 is connected to the upper end of each cylinder head 6.

A lower crankcase 8 is connected to the lower part of the cylinder block 5, that is, the upper crankcase part 5*c* and an oil pan 10 are connected to the lower end of the lower crankcase 8.

Front and rear cylinder holes 11 and 12 are provided to the front and rear cylinder parts 5*a* and 5*b* and pistons 13 and 14 are respectively fitted into the cylinder holes 11 and 12 so that the pistons can be slid.

An air cleaner 15 common to both cylinder parts 5*a* and 5*b* and a suction system 17 including carburetors 16 individually corresponding to both cylinder parts 5*a* and 5*b* are arranged between the front cylinder part 5*a* and the rear cylinder part 5*b*.

A crankshaft 20 is coupled to both of the above pistons 13 and 14 via connecting rods 18 and 19 is supported between the upper crankcase 5*c* and the lower crankcase 8 so that the crankshaft can be rotated.

Figure 2:
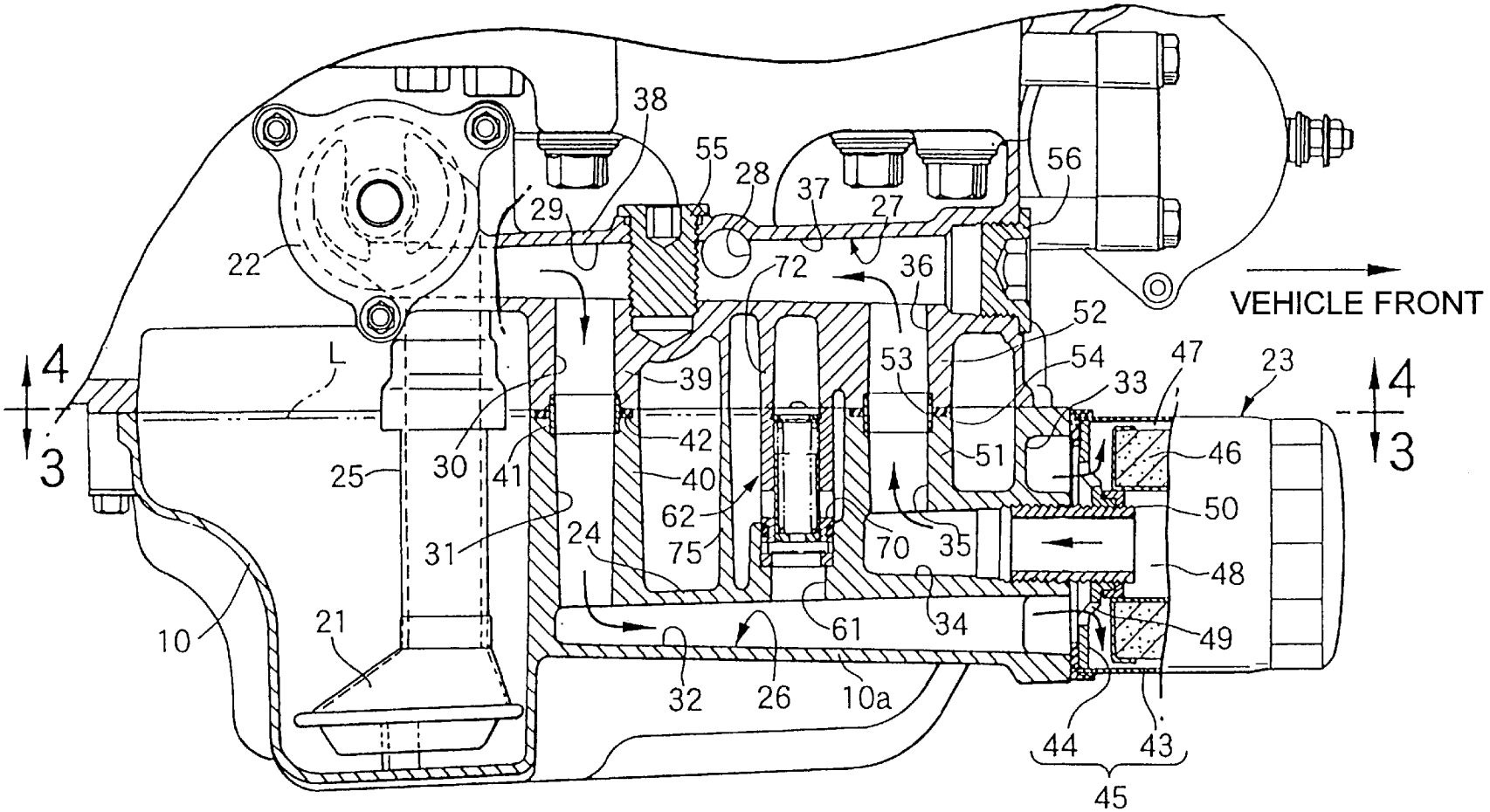
FIG. 2 is a sectional side view in which the main part shown in FIG. 1 is enlarged.
Figure 3:
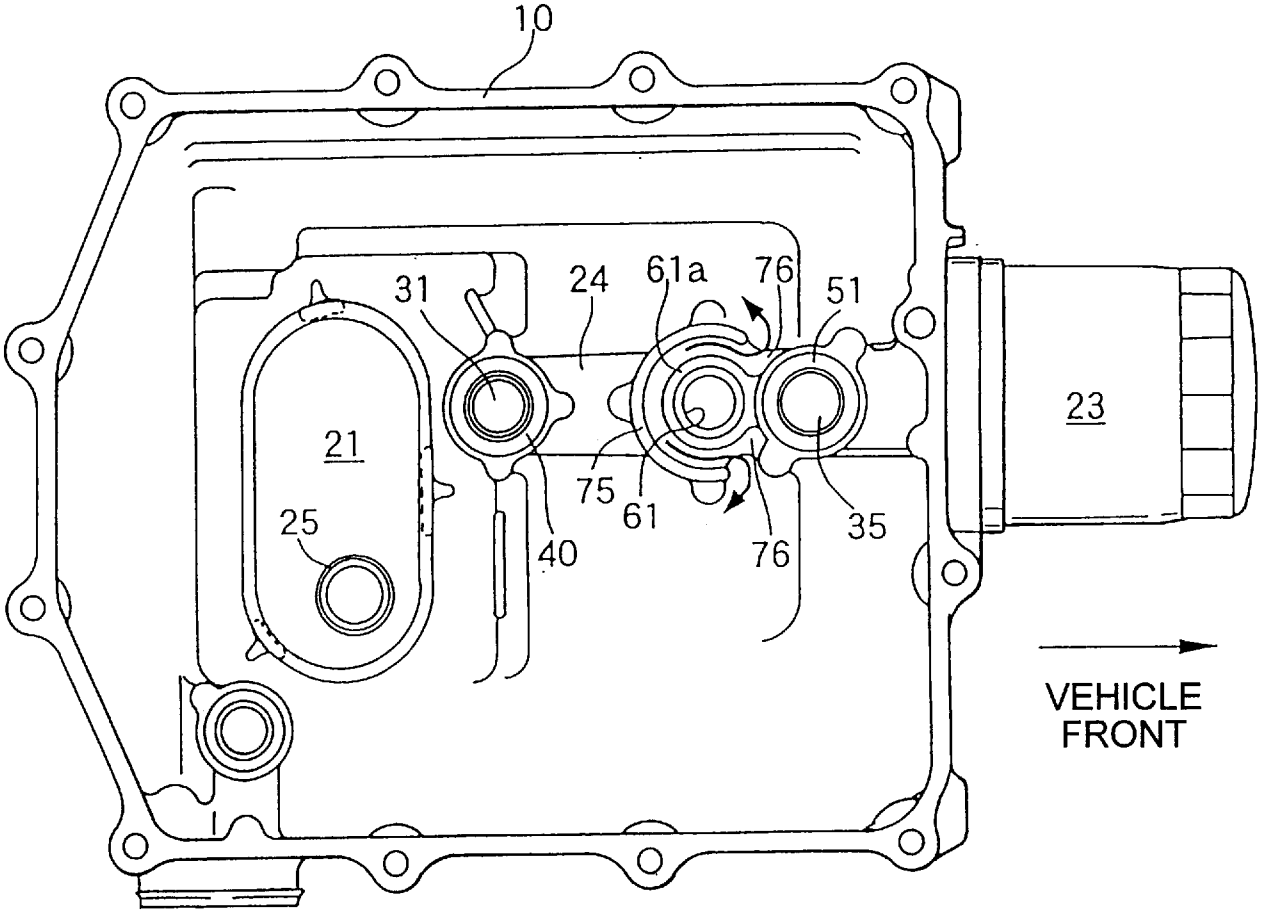
FIG. 3 is a plan view showing an oil pan when viewed along a line 3—3 in FIG. 2.
Figure 4:
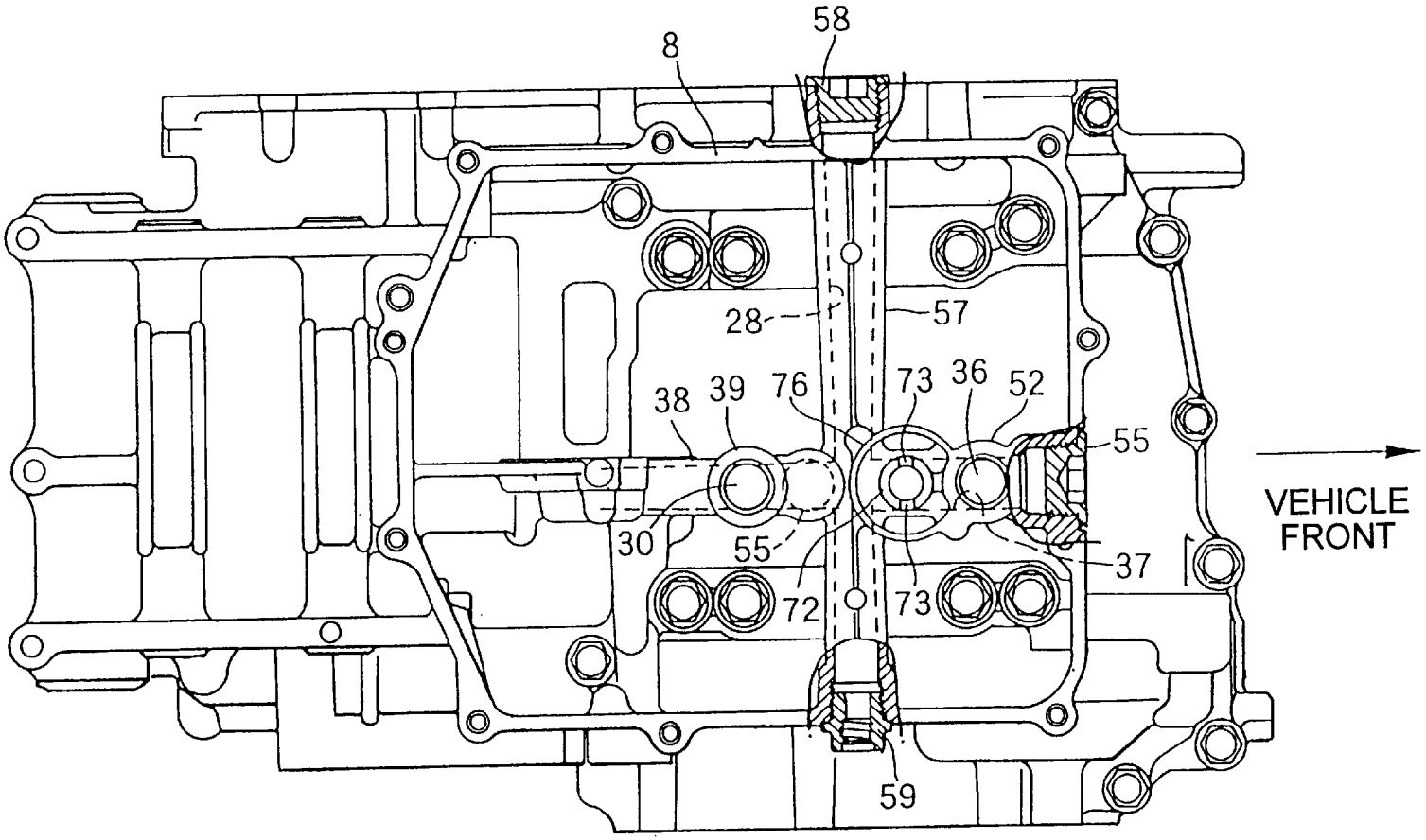
FIG. 4 is a bottom view showing a lower crankcase when viewed along a line 4—4 in FIG. 2.

Also referring to FIGS. 2 and 4, an oil strainer 21 is arranged in the oil pan 10, an oil pump 22 for sucking oil from the oil strainer 21 is arranged on the side of the lower crankcase 8. Oil discharged from the oil pump 22 is supplied to an oil filter 23 via a feed oil passage 26 and oil after it is purified by the oil filter 23 is supplied to a main gallery 28 via a feed oil passage 27.

The oil strainer 21 is arranged at the bottom of the oil pan 10 on the rear side in a vehicular travel direction and the oil pump 22 is arranged on the side of the lower crankcase 8 in the upper part of the oil strainer 21. An oil sucking pipe 25 extending upwardly from the oil strainer 21 is connected to the inlet of the oil pump 22.

The oil filter 23 is attached to the outside surface of the oil pan 10 on the front side in the vehicular travel direction, the bottom of the oil pan 10 between the oil filter 23, the oil strainer 21 is formed as an uplifted part uplifted upwardly from a part in which the oil strainer 21 is arranged and a passage forming part 24 is provided adjacent to the uplifted part.

The feed oil passage 26 connecting the oil pump 22 and the oil filter 23 includes oil passages 29 and 30 provided in the lower crankcase 8, oil passages 31 and 32 provided in the oil pan 10 and a circular groove 33. The feed oil passage 27 connecting the oil filter 23 and the main gallery 28 is constituted by oil passages 34 and 35 provided in the oil pan 10 and oil passage 36 and 37 provided in the lower crankcase 8.

The oil passage 29 extends approximately horizontally on the front side in a vehicular travel direction with one end communicating with the oil pump 22 and the upper end of the oil passage 30 vertically extending in communication with the other end of the oil passage 29. The oil passage 29 is formed in a part on the side of the oil pump 22 in a first horizontal cylindrical part 38 provided in the lower crankcase 8 with the oil passage extending to the front side in the vehicular travel direction from the oil pump 22. The oil passage 30 is formed in a first downwardly extending cylindrical part 39 provided on the lower crankcase 8 with the oil passage extending downwardly from the first horizontal cylindrical part 38.

In the meantime, in the oil pan 10, a first rising cylindrical part 40 rising from a part corresponding to the first downwardly extending cylindrical part 39 of the passage forming part 24 is integrated with the oil pan 10 and the oil passage 31 is formed in the first rising cylindrical part 40. When the lower crankcase 8 and the oil pan 10 are connected, the lower end of the first downwardly extending cylindrical part 39 and the upper end of the first rising cylindrical part 40 are joined via a circular sealing member 42, and the oil passages 30 and 31 coaxially communicate via a connection pipe 41 between the lower part of the first downwardly extending cylindrical part 39 and the upper part of the first rising cylindrical part 40.

One end of the oil passage 32 is approximately perpendicularly connected to the lower end of the oil passage 31. The oil passage 32 is formed in the passage forming part 24 of the oil pan 10 with the oil passage approximately horizontally extended to the front side in a vehicular travel direction from the lower end of the oil passage 31 as a cast hole when the oil pan 10 is cast.

The circular groove 33 is formed on the outside face of the oil pan 10 on the front side in a vehicular travel direction with the circular groove communicating with the other end of the oil passage 32, and the oil filter 23 is attached to the outside surface of the oil pan 10 so that the oil filter covers the circular groove 33.

The oil filter 23 is provided with a casing 45 formed by closing the opening end of a cylindrical casing body 43 provided with a bottom with a cover plate 44 and a filter medium 46 formed in a cylindrical shape and housed in the casing 45. In the casing 45 a circular unpurified chamber 47 between the filter medium 46 and the casing body 43 and a purifying chamber 48 inside the filter medium are formed. Plural communicating holes 49 for connecting the circular groove 33 to the unpurified chamber 47 are provided to the cover plate 44. An outlet pipe 50 communicating with the purifying chamber 48 and through the center of the cover plate 44 is screwed to the oil pan 10.

The oil passage 34 constituting a part of the feed oil passage 27 connecting the oil filter 23 and the main gallery 28 is formed in the passage forming part 24 with the oil passage approximately horizontal over the oil passage 32 in the feed oil passage 26. The oil passage 34 includes one end open on the outside face of the oil pan 10 and extends on the rear side in a vehicular travel direction. The outlet pipe 50 of the oil filter 23 is coaxially connected to one end of the oil passage 34.

The other end of the oil passage 34 is closed and a second rising cylindrical part 51 forming the oil passage 35 communicating with the other end of the oil passage 34 is integrated with the oil pan 10 so that the second rising cylindrical part rises upwardly from the passage forming part 24. In the meantime, a second downwardly extending cylindrical part 52 extends downwardly from a part corresponding to the second rising cylindrical part 51 in the first horizontal cylindrical part 38 of the lower crankcase 8 is integrated with the lower crankcase 8 and the oil passage 36 is formed in the second downwardly extending cylindrical part 52. When the lower crankcase 8 and the oil pan 10 are connected, the upper end of the second rising cylindrical part 51 and the lower end of the second downwardly extending cylindrical part 52 are joined via a circular sealing member 54 and the oil passages 35 and 36 coaxially communicate via a connection pipe 53 between the upper part of the second rising cylindrical part 51 and the lower part of the second downwardly extending cylindrical part 52.

The oil passage 37 is formed in a part on the front side in a vehicular travel direction in the first horizontal cylindrical part 38 provided to the lower crankcase 8 and the upper end of the oil passage 36 is formed in the second downwardly extending cylindrical part 52 which communicates approximately perpendicularly with one end of the oil passage 37.

The oil passage 29 communicates with the oil pump 22 and constitutes a part of the feed oil passage 26 and the oil passage 37 connected to the oil filter 23 via the oil passages 36, 35 and 34. These passages are coaxially formed in the first horizontal cylindrical part 38 in the lower crankcase 8 by a cast hole formed between the outside face of the lower crankcase 8 and a part corresponding to the oil pump 22 when the lower crankcase 8 is cast and partitioned by a bolt 55. That is, the bolt 55 provided with the larger outside diameter than the inside diameter of the cast hole is screwed to the middle part of the first horizontal cylindrical part 38 so that the bolt crosses the cast hole. A plug member 56 closes the outside end opening of the cast hole and screwed to the lower crankcase 8.

A second horizontal cylindrical part 57 approximately perpendicular to the first horizontal cylindrical part 38 is integrated with the lower crankcase 8, a cast hole both ends of which are open, is formed in the second horizontal cylindrical part 57 when the lower crankcase 8 is cast, one end of the cast hole is closed by a plug member 58 and a connection pipe member 59 for connecting pipes not shown is screwed to the other end of the cast hole. Hereby, the main gallery 28 is formed in the second horizontal cylindrical part 57 and approximately perpendicularly communicates with the other end of the oil passage 37.

Figure 5:
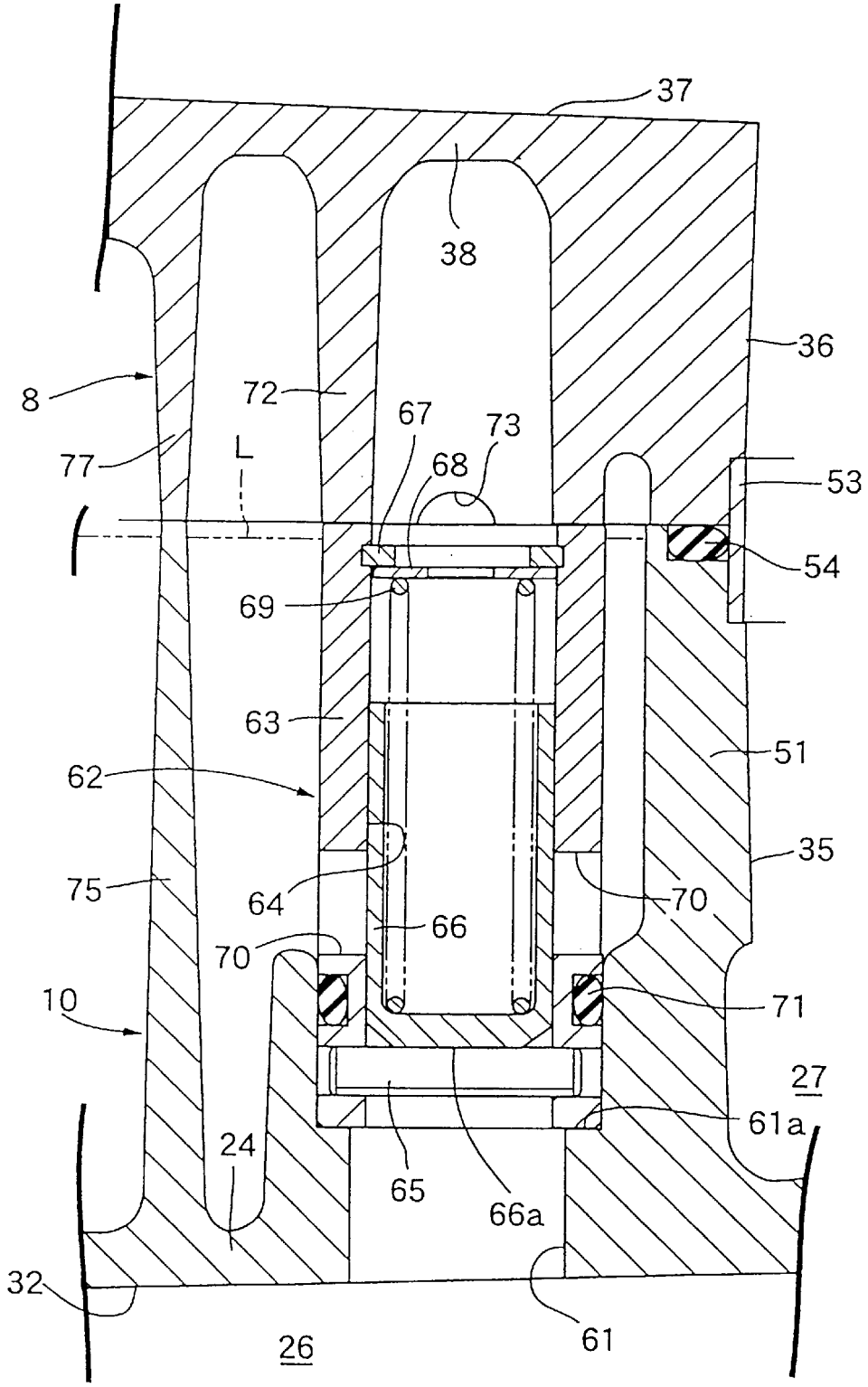
FIG. 5 is an enlarged drawing showing the vicinity of an oil relief valve shown in FIG. 2.

Also referring to FIG. 5, in the passage forming part 24 of the oil pan 10, a connecting hole 61 is provided in its middle part with a circular part with difference in a level 61*a* provided with an axis which is approximately perpendicular to the axis of the oil passage 32, which communicates with the middle part of the oil passage 32 and is directed upwardly and is provided so that the upper end of the connecting hole is open on the upper surface of the passage forming part 24. The connecting hole 61 is formed as a cast hole when the oil pan 10 is cast.

Oil is stored in the oil pan 10 at an oil level L shown by a two-dot long and two short dashes line and an oil relief valve 62 is dipped in the oil and is coaxially connected to the connecting hole 61 with the oil relief valve held between the oil pan 10 and the lower crankcase 8.

The oil relief valve 62 is provided with a cylindrical housing 63 having a sliding hole 64 with both ends opened. A regulating pin 65 crosses the sliding hole 64 and is attached on the side of one end of the housing 63. A cylindrical plunger 66 is provided with a bottom which directs the outside surface of the closed part which is a pressure receiving surface 66a toward the regulating pin 65 and is fitted into the sliding hole 64 of the housing 63 to permit sliding of the plunger. A ring wear plate 68 is supported by a retaining ring 67 and is attached to the inner surface on the side of the other end of the housing 63. A spring 69 is provided as a spring means between the wear plate 68 and the closed part of the plunger 66. In addition, plural relief ports 70 are provided on the peripheral wall of the housing 63 in the vicinity of the pressure receiving surface 66*a* of the plunger 66 and are provided to the housing 63 so that the plural relief ports are closed by the plunger 66 while the pressure receiving surface 66*a* of the plunger 66 is in contact with the regulating pin 65 by the pressure of the spring 69. However, the plural relief ports are open when the pressure receiving surface 66*a* of the plunger 66 is separated from the regulating pin 65 by oil pressure operating upon the pressure receiving surface 66*a* and is moved to the other end side of the housing 63. Adjacent one end of the housing 63 of the oil relief valve 62 is received by the part with a difference in a level 61*a* which is fitted into the connecting hole 61 and a circular sealing member 71 which touches to the inner surface of the connecting hole 61 for sealing is attached to the outside surface of the housing 63. That is, the oil relief valve 62 is coaxially connected to the connecting hole 61 with the pressure receiving surface 66*a* of the plunger 66 directed downwardly, that is, towards the connecting hole 61.

A supporting cylindrical part 72 extends downwardly from the first horizontal cylindrical part 38 and is integrated with the lower crankcase 8, the lower end of the supporting cylindrical part 72 is fitted into the connecting hole 61 when the lower crankcase 8 and the oil pan 10 are connected and the end comes in contact with the other end, that is, the upper end of the connected housing 63, and the housing 63 of the oil relief valve 62 is held between the part with a difference in a level 61*a* of the connecting hole 61 and the supporting cylindrical part 72. The upper end of the supporting cylindrical part 72 is closed and for example, a pair of grooves 73 for preventing the operation of the plunger 66 from being awkward because of the space over the plunger 66 in the oil relief valve 62 is sealed and a cut-off port is formed and provided for air between the lower end of the supporting cylindrical part 72 and the upper end of the housing 63 on the lower end face of the supporting cylindrical part 72.

The oil relief valve 62 is arranged between the oil filter 23 and the oil strainer 21 and is integrated with the bottom of the oil pan 10 with a wall part 75 surrounding the oil relief valve 62 on the side of the oil strainer 21 rising upwardly from the passage forming part 24. The wall part 75 is formed so that it is provided with an arc-shaped cross section in the range of 180 or more with the axis of the oil relief valve 62. More specifically, the axis of the connecting hole 61 in the center for example and passages 76 are respectively formed between both ends in the peripheral direction of the wall part 75 and the second rising cylindrical part 51 is arranged between the oil relief valve 62 and the oil filter 23.

In addition, the wall part 75 is formed so that the upper end is located above the relief port 70 of the oil relief valve 62 and in this embodiment, the upper end of the wall part 75 is set to the same level as the respective upper ends of the first and second rising cylindrical parts 40 and 51. In the meantime, a supporting wall part 77, the cross section of which is formed in the shape of an arc corresponding to the wall part 75 and both ends in the peripheral direction of which are connected to the second downwardly extended cylindrical part 52, is integrated with the lower crankcase 8. The supporting wall part 77 extends downwardly from the first horizontal cylindrical part 38. When the lower crankcase 8 and the oil pan 10 are connected, the lower end of the supporting wall part 77 is joined to the upper end of the wall part 75.

Next, describing the action of this embodiment, as the oil relief valve 62 is connected to the connecting hole 61 provided in the passage forming part 24 integrated with the bottom of the oil pan 10 with the pressure receiving surface 66*a* of the plunger 66 directed downwardly, the relief port 70 which is arranged in the vicinity of the pressure receiving surface 66*a* can be arranged in a relatively low position in the oil pan 10. Therefore, oil which is discharged from the relief port 70 located in a relatively downwardly and distant position from the oil lever L in the oil pan 10 and air at the oil level L and oil from the relief port 70 can be prevented from being mixed to the utmost. In addition, as the wall part 75 the upper end of which is located in a higher position than the relief port 70 is located between the oil relief valve 62 and the oil strainer 21, relief oil discharged from the relief port 70 does not directly flow on the side of the oil strainer 21. As the relief oil flows on the side reverse to the oil strainer 21 and is inverted respectively via the passages 76 and flows on the side of the oil strainer 21, air is eliminated from the oil to the utmost while the oil turns around the wall part 75 even if air is mixed in the oil flowing from the relief port 70 and air can be prevented from being mixed in with the oil as the oil is sucked by the oil strainer 21. In addition, as the wall part 75 is integrated with the oil pan 10, the number of parts is not increased.

As the oil passage 32 and the connecting hole 61 constitute a part of the feed oil passage 26 connecting the oil pump 22 and the oil filter 23 are formed as a cast hole when the oil pan 10 is cast, the oil passage 32 and the connecting hole 61 are not required to be especially formed after the oil pan 10 is cast and the number of the manufacturing processes of the oil pan 10 can be reduced.

Further, as a cast hole is formed when the lower crankcase 8 is cast for connecting the bolt 55 which crosses the middle part of the above cast hole and is screwed to the lower crankcase 8. The cast hole is partitioned into the oil passage 29 communicating with the oil pump 22 and the oil passage 37 one end of which is connected to the oil filter 23 and the other end of which communicates with the main gallery 28. Thus, the constitution of the feed oil passages 26 and 27 can be simplified and the oil passages 29 and 37 are not required to be especially formed after the lower crankcase 8 is cast and the number of manufacturing processes can be reduced.

The embodiment of the present invention is described in detail above, however, the present invention is not limited to the above embodiment and various variations of design are allowed unless they deviate from the present invention disclosed in the claims.

For example, in the above embodiment, the oil relief valve 62 is held and supported between the lower crankcase 8 and the oil pan 10, however, the oil relief valve has only to be supported by either of the lower crankcase 8 or the oil pan 10.

As described above, according to the present invention, as an oil relief valve is connected to a connecting hole provided in a passage forming part integrated with the bottom of an oil pan with the pressure receiving surface of its plunger directed downwardly, the relief port of the oil relief valve can be arranged in a relatively low position in the oil pan and air at an oil level and oil from the relief port can be prevented from being mixed to the utmost. In addition, as a wall part is provided between the oil relief valve and an oil strainer, air can be eliminated from oil to the utmost while the oil turns around the wall part even if the air is mixed in the oil flowing from the relief port and air can be prevented from being mixed in oil sucked by the oil strainer to the utmost. Further, as the wall part is integrated with the oil pan, the number of parts is not increased.

Also, according to the present invention, an oil passage and a connecting hole are not required to be especially formed after an oil pan is cast and the number of the manufacturing processes of the oil pan can be reduced.

Further, according to the present invention, the constitution of a feed oil passage can be simplified, the number of processes applied to a crankcase after casting can be reduced and the number of the manufacturing processes of the crankcase can be reduced.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A lubricating system of an internal combustion engine comprising:

an oil relief valve provided with a housing provided with a relief port on the peripheral wall, a plunger provided with a pressure receiving surface at one end, enabling opening or closing of said relief port and fitted to the housing so that the plunger can be reciprocated and spring means for pressing the plunger in a direction in which said relief port is closed;

said oil relief valve being adapted to be disposed in oil in a cast oil pan connected to the lower end of a crankcase and being positioned at approximately a halfway portion of a feed oil passage connecting an oil pump and an oil filter, wherein the oil filter is attached to the outside surface of the oil pan;

an oil passage constituting a part of said feed oil passage, said oil passage extends approximately horizontally and connects to the oil filter and a connecting hole which is provided with an axis approximately perpendicular to said oil passage for communicating with approximately a middle part of said oil passage and is open on an upper surface of a passage forming part formed in said passage forming part integrated with a bottom of the oil pan;

the oil relief valve being supported by at least one of the oil pan and the crankcase is coaxially connected to said connecting hole with the pressure receiving surface of the plunger directed downwardly;

the oil relief valve is surrounded on the side of an oil strainer arranged in the oil pan and connected to an oil pump; and a wall rising to a higher position than the position of the relief port of the oil relief valve is integrated with the bottom of the oil pan.

2. The lubricating system of an internal combustion engine according to claim 1, wherein said oil passage and said connecting hole are formed as a cast hole when the oil pan is cast.

3. The lubricating system of an internal combustion engine according to claim 1, wherein a linear cast hole is formed in said cast crankcase and a bolt partitioning said cast hole into an oil passage communicating with said oil pump and an oil passage one end of which is connected to said oil filter and the other end of which communicates with a main gallery is screwed to said crankcase.

4. The lubricating system of an internal combustion engine according to claim 1, wherein the oil pump is disposed in a portion of the oil pan adjacent to said oil strainer for supplying oil from said oil pan to said oil passage, said oil filter and said oil relief valve.

5. The lubricating system of an internal combustion engine according to claim 4, wherein said oil passage includes a first passage extending downwardly from said oil pump, a second, approximately horizontal passage being in communication with said oil filter and a third oil passage being approximately perpendicular to said second passage for retaining said oil relief valve therein.

6. The lubricating system of an internal combustion engine according to claim 1, wherein said plunger of said oil relief valve includes a hollow space disposed within with an open portion for receiving said spring means for biasing said oil relief valve to a normally closed position.

7. The lubricating system of an internal combustion engine according to claim 1, and further including a regulating pin disposed adjacent to said plunger for regulating the downward displacement of said oil relief valve.

8. A lubricating system of an internal combustion engine comprising:

an oil relief valve mounted for reciprocation within an opening in a housing provided with a relief port on the peripheral wall, a plunger provided with a pressure receiving surface at one end for enabling opening or closing of said relief port and fitted within said opening in the housing so that the plunger can be reciprocated and spring means for pressing the plunger in a direction in which said relief port is normally closed;

said oil relief valve being adapted to be disposed in oil in a cast oil pan connected to the lower end of a crankcase and being positioned at approximately a halfway portion of a feed oil passage connecting an oil pump and an oil filter, wherein the oil filter is attached to an outside surface of the oil pan;

an oil passage constituting a part of said feed oil passage, said oil passage extends approximately horizontally and connects to the oil filter and a connecting hole which is provided with an axis approximately perpendicular to said oil passage for communicating with approximately a middle part of said oil passage and is open on an upper surface of a passage forming part formed in said passage forming part integrated with a bottom of the oil pan;

the oil relief valve being supported by at least one of the oil pan and the crankcase is coaxially connected to said connecting hole with the pressure receiving surface of the plunger directed downwardly; and said opening for said oil relief valve including a wall projecting to a higher position than the position of the relief port of the oil relief valve.

9. The lubricating system of an internal combustion engine according to claim 8, wherein said oil passage and said connecting hole are formed as a cast hole when the oil pan is cast.

10. The lubricating system of an internal combustion engine according to claim 8, wherein a linear cast hole is formed in said cast crankcase and a bolt partitioning said cast hole into an oil passage communicating with said oil pump and an oil passage one end of which is connected to said oil filter and the other end of which communicates with a main gallery is screwed to said crankcase.

11. The lubricating system of an internal combustion engine according to claim 8, and further including an oil pump being disposed in a portion of the oil pan adjacent to said oil strainer for supplying oil from said oil pan to said oil passage, said oil filter and said oil relief valve.

12. The lubricating system of an internal combustion engine according to claim 11, wherein said oil passage includes a first passage extending downwardly from said oil pump, a second, approximately horizontal passage being in communication with said oil filter and a third oil passage being approximately perpendicular to said second passage for retaining said oil relief valve therein.

13. The lubricating system of an internal combustion engine according to claim 8, wherein said plunger of said oil relief valve includes a hollow space disposed within with an open portion for receiving said spring means for biasing said oil relief valve to a normally closed position.

14. The lubricating system of an internal combustion engine according to claim 8, and further including a regulating pin disposed adjacent to said plunger for regulating the downward displacement of said oil relief valve.

* * * * *